US005277360A

United States Patent [19]

DeMott

[11] Patent Number: 5,277,360

[45] Date of Patent: Jan. 11, 1994

[54] STACKABLE CONTAINER

[75] Inventor: Kenneth P. DeMott, Jenison, Mich.

[73] Assignee: Packaging Corporation of America, Evanston, Ill.

[21] Appl. No.: 976,908

[22] Filed: Nov. 16, 1992

[51] Int. Cl.[5] ..... B65D 5/42; B65D 5/64

[52] U.S. Cl. ..... 229/122; 229/162; 229/164; 229/167; 229/178

[58] Field of Search ..... 229/122, 162, 164, 167, 229/168, 178, 915, DIG.; 206/44 R

[56] References Cited

U.S. PATENT DOCUMENTS

| | | | |
|---|---|---|---|
| 2,349,241 | 5/1944 | Arneson | 229/167 |
| 2,675,166 | 4/1954 | Main | 229/167 |
| 2,747,732 | 5/1956 | Fischer | 229/164 |
| 2,757,853 | 8/1956 | Main | 229/168 |
| 3,014,635 | 12/1961 | Mairs et al. | 229/167 |
| 3,143,275 | 8/1964 | Diggs | 229/168 |
| 3,162,350 | 12/1964 | Miller | 229/168 |
| 3,784,083 | 1/1974 | Pfaffendorf et al. | 229/164 |
| 4,211,322 | 7/1980 | Crescenzi et al. | 206/44 R |
| 4,896,825 | 1/1990 | Moeller | 229/167 |
| 4,907,693 | 3/1990 | Child | 206/44 R |

FOREIGN PATENT DOCUMENTS

| | | | |
|---|---|---|---|
| 1253920 | 1/1961 | France | 229/167 |
| 640355 | 5/1962 | Italy | 229/167 |
| 2220406 | 1/1990 | United Kingdom | 229/178 |

*Primary Examiner*—Gary E. Elkins
*Attorney, Agent, or Firm*—Arnold, White & Durkee

[57] ABSTRACT

A stackable container is formed from a unitary continuous corrugated or sold fiberboard blank for storage of shipped goods. The stackable container includes a bottom portion, first and second opposing side panels, a back panel, and a front panel. The side panels and the back panel have corresponding rigid ledges along uppermost edges of the panels which are capable of supporting another similar or identical stackable container on top of this one. The side panels and the back panel are made from a corresponding pair of planar layers. The ledge corresponding to each panel is connected to and bridges between the corresponding pair of planar layers. The front panel has a display opening for viewing and accessing contents of the stackable container. The stackable container also includes a lid used during shipment of the container.

11 Claims, 5 Drawing Sheets

STACKABLE CONTAINER

BACKGROUND OF THE INVENTION (a) Field of the Invention

The present invention generally relates to corrugated or solid fiberboard containers and, more particularly, is concerned with corrugated or solid fiberboard containers which are particularly adapted for being stacked on top of one another in stores.

(b) Description of the Prior Art

Goods such as meat, poultry, fish, hardware, housewares, sporting goods, and other similar merchandise are typically shipped in standard boxes known as half-slot containers. Half-slot containers have a body section and a lid. The body section includes pair of opposing side panels, a front panel, a back panel, and a bottom portion. The opposing side panels, the front panel, and the back panel are typically composed of one layer of corrugated or fiberboard. The bottom portion is formed from two flaps, where each flap is connected to one of the opposing side panels. The flaps come together to form the bottom portion, and they are typically taped to one another so that the bottom portion is sturdy. The lid may be either a design style or a half-slotted style, and the lid may extend to an fraction of the depth of the body section.

A display opening is often cut into one or more of the body section panels so that goods within the container can be viewed or accessed through the display opening. When there is a display opening in the body section of the container, the lid must extend to such a depth of the body section that goods within the container are not exposed during shipping from producers to stores. When the goods reach the stores, store owners often prefer to store the shipped goods in the containers prior to sale. In order to use their selling space most efficiently, the store owners remove the container lids and stack the containers on top of one another. Store customers are able to view and access goods through the display opening.

The problem with the above practice is that containers at the bottom of a stack buckle under the weight of the containers stacked above them. Due to this buckling, contents of the buckling container may be either damaged or destroyed. In addition, containers at the top of the stack may fall over because of a lack of support.

Thus, a need exists for a corrugated or fiberboard container which provides superior stacking strength and stability without the use of a lid during stacking, and which allows store customers to view and access contents of the container when positioned in a stack of such containers.

SUMMARY OF THE INVENTION

The present invention provides a corrugated or fiberboard container designed to satisfy the aforementioned needs. First, the container of the present invention provides superior stacking strength and stability by use of rigid ledges along the uppermost edges of the side panels and back panel of the container. Each panel is formed from a pair of planar layers of board, and the rigid ledge on each panel connects the uppermost edge of one planar layer to the uppermost edge of the other planar layer. The ledges provide superior strength and rigidity because each ledge is supported by two planar layers of board. As a result, a stack of containers having rigid ledges is easy to assemble and disassemble.

Second, the container of the present invention provides a display opening to allow a store customer to view and access contents of a stacked container.

Third, the container of the present invention is produced from a corrugated or solid fiberboard blank. An advantage of the blank used to form the container is that it is compatible with high speed packaging lines.

Accordingly, the present invention relates to a stackable container formed from a unitary continuous corrugated or solid fiberboard blank for storage of shipped goods. The stackable container includes a bottom portion; first and second opposing side panels connected to the bottom portion; a back panel connected to the bottom portion and bridging the first and second side panels; and a front panel connected to the bottom portion, opposing the back panel, and bridging the first and second side panels. Each of the side panels has a corresponding rigid ledge along an uppermost edge of the panel. The rigid ledges are capable of supporting another similar or identical stackable container on top of this one. The back panel may also include a rigid ledge along an uppermost edge of the back panel to aid the other rigid ledges in supporting another stackable container. Also, the front panel has a display opening for viewing and accessing contents of the stackable container.

More specifically, each of the side panels and the back panel are made from a corresponding pair of planar layers. The ledge corresponding to each panel is connected to and bridges between the corresponding pair of planar layers. The stackable container also includes a lid used during shipment of the container. The lid covers the display opening in the front panel so that contents of the container are not exposed during shipment.

BRIEF DESCRIPTION OF THE DRAWINGS

The advantages of the present invention will become apparent upon reading the following detailed description and upon reference to the accompanying drawings, in which.

DESCRIPTION OF THE PREFERRED EMBODIMENT

Figure 1:
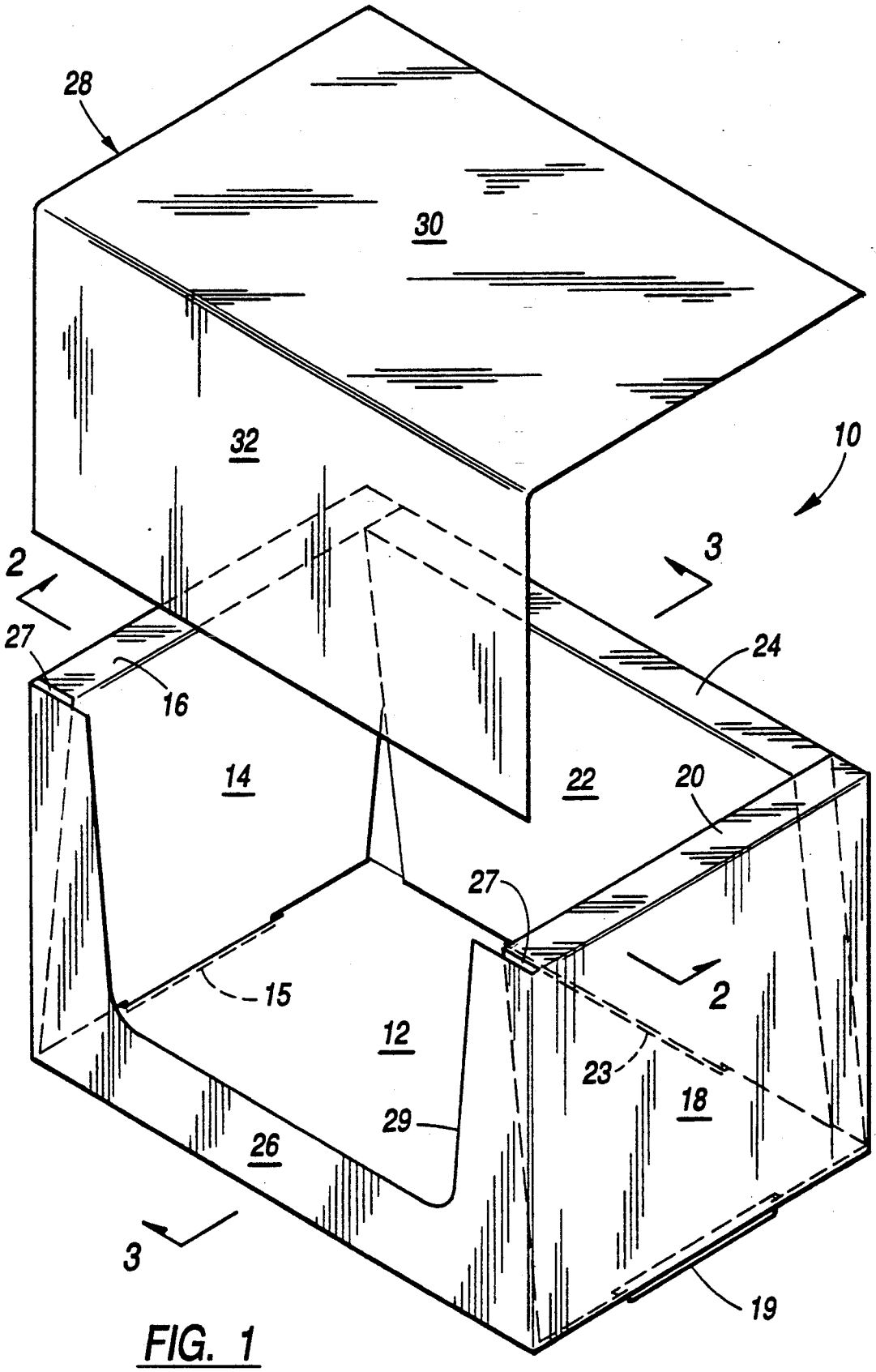
FIG. 1 is a perspective view of the preferred embodiment of the stackable container of the present invention, with a lid removed from a container body.

Referring now to the drawings, and more particularly to FIG. 1, there is shown a stackable container formed from a unitary continuous corrugated or solid fiberboard blank for storage of shipped goods, generally designated by the reference numeral 10. The stackable container 10 comprises the preferred embodiment of the present invention.

The stackable container 10 includes (a) a bottom portion 12; (b) a first side panel 14 connected to the bottom portion 12; (c) a second side panel 18 opposing the first side panel 14 and connected to the bottom portion 12; (d) a back panel 22 connected to the bottom portion 12 and bridging the first and second side panels 14 and 18; (e) a front panel 26 connected to the bottom portion 12, opposing the back panel 22, and bridging the first and second side panels 14 and 18; and (f) a lid 28. The front panel 26 includes a display opening 29 to allow for viewing and accessing contents of the stackable container 10.

Figure 2:
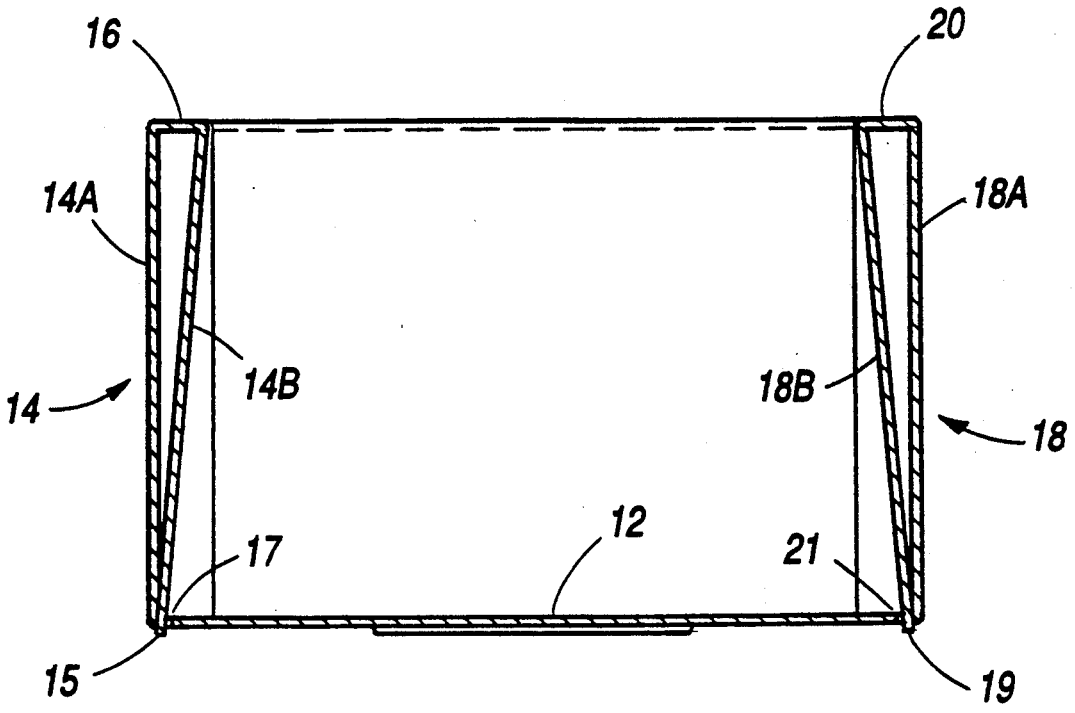
FIG. 2 is a cross-sectional view of the container body of the stackable container shown in FIG. 1 taken along the line 2—2 of FIG. 1.

In the preferred embodiment, three of the four panels have a rigid ledge running along the uppermost edge of the panel. The first side panel 14 has a first rigid ledge 16 along an uppermost edge of the first side panel 14. The second side panel 18 has a second rigid ledge 20 along an uppermost edge of the second side panel 18. Finally, the back panel 22 has a third rigid ledge 24 along an uppermost edge of the back panel 22. The rigid ledges are capable of supporting another stackable container on top of this one. Moreover, due to their strength, the rigid ledges provide a sturdy foundation for stacking several stackable containers on top of one another. The rigid ledges 16, 20, and 24 are preferably formed from pairs of planar layers as follows. Referring to FIG. 2, there is shown a cross-sectional view of the first and second side panels 14 and 18 of FIG 1. Both of the side panels 14 and 18 are connected to the bottom portion 12. The first side panel 14 is formed from a first pair of planar layers 14A and 14B with the first rigid ledge 16 integrally connected to and bridging an uppermost edge of each of the first pair of layers 14A and 14B. The first layer 14A of the first pair of layers is integrally connected to the bottom portion 12, and the second layer 14B of the first pair of layers connects to the bottom portion 12 by use of a first locking tab 15 which interlocks with a corresponding first locking slot 17 in the bottom portion 12. The first layer 14A and the second layer 14B define an acute angle whose vertex is located at the first locking slot 17.

The second side panel 18 is formed from a second pair of planar layers 18A and 18B with the second rigid ledge 20 integrally connected to and bridging an uppermost edge of each of the second pair of layers 18A and 18B. The first layer 18A of the second pair of layers is integrally connected to the bottom portion 12, and the second layer 18B of the second pair of layers connects to the bottom portion 12 by use of a second locking tab 19 which interlocks with a corresponding second locking slot 21 in the bottom portion 12. The first layer 18A and the second layer 18B define an acute angle whose vertex is located at the second locking slot 21.

Figure 3:
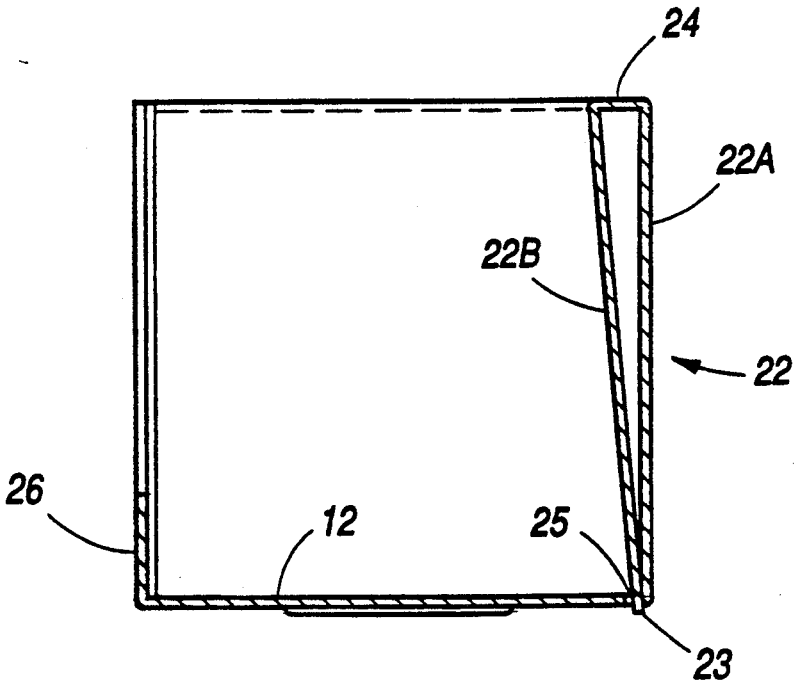
FIG. 3 is a cross-sectional view of the container body of the stackable container shown in FIG. 1 taken along the line 3—3 of FIG. 1.

Referring to FIG. 3, there is shown a cross-sectional view of the back panel 22 and the front panel 26 shown in FIG. 1. The back panel 22 is formed from a third pair of planar layers 22A and 22B with the third rigid ledge 24 integrally connected to and bridging an uppermost edge of each of the third pair of layers 22A and 22B. The first layer 22A of the third pair of layers is integrally connected to the bottom portion 12, and the second layer 22B of the third pair of layers connects to the bottom portion 12 by use of a third locking tab 23 which interlocks with a corresponding third locking slot 25 in the bottom portion 12. The first layer 22A and the second layer 22B define an acute angle whose vertex is located at the third locking slot 25. The first, second, and third locking tabs 15, 19, and 23, respectively, are also illustrated by dotted lines in FIG. 1.

Figure 4:
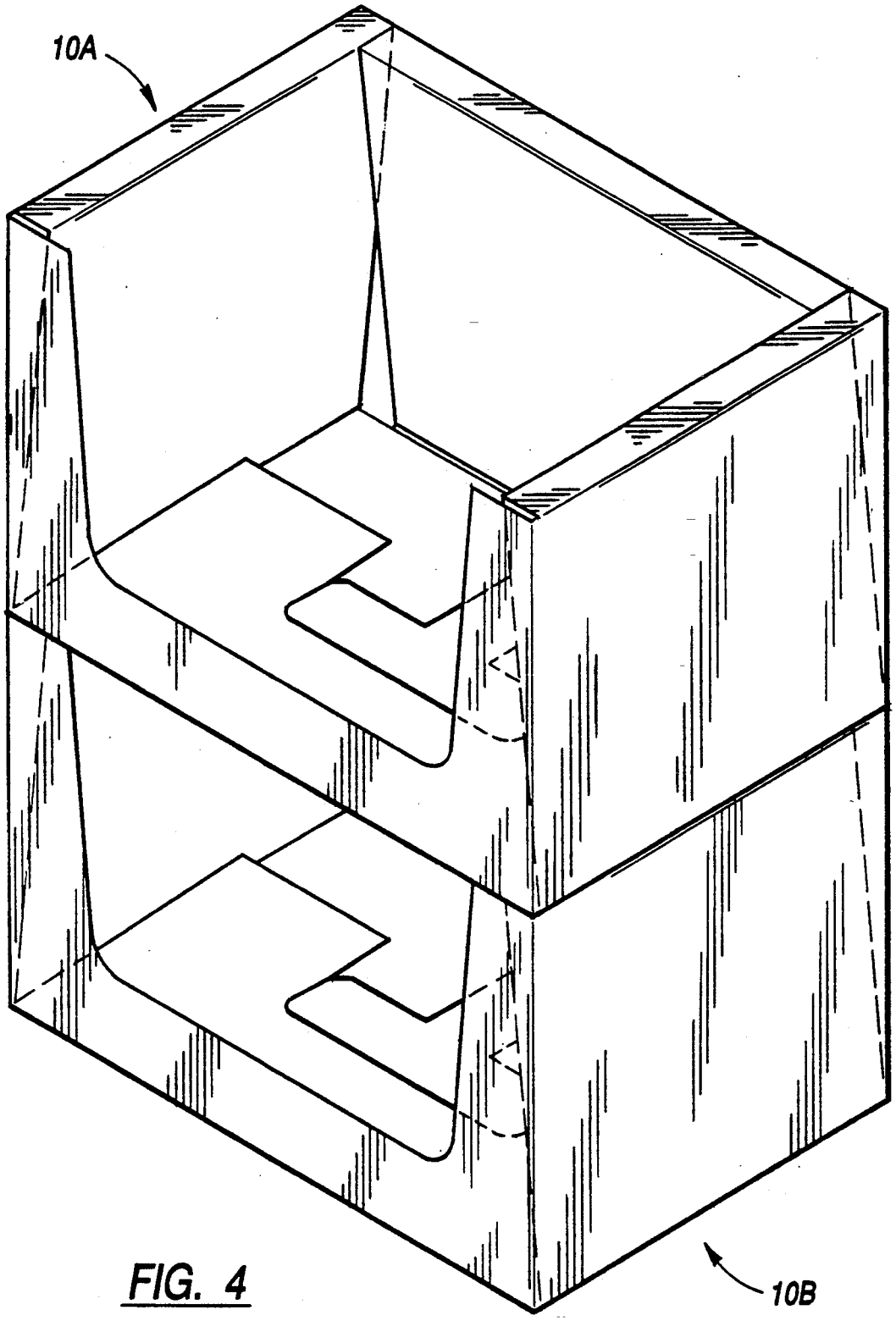
FIG. 4 is a perspective view of a first stackable container of the present invention stacked on top of a second similar or identical stackable container.

In order to reduce the amount of space utilized by containers, store owners often stack the containers on top of one another. As depicted in FIG. 4, one stackable container 10A may be easily stacked on top of another similar or identical stackable container 10B. The bottom portion of the first stackable container 10A tests on top of and is supported by the rigid ledges of the second stackable container 10B. Additional stackable containers may be stacked on top of the first stackable container 10A in similar fashion. Unlike standard half-slot containers whose walls tend to buckle when the containers are stacked on top of one another, the rigid ledges of the second stackable container 10B provide a strong, stable support for the first stackable container 10A. When contents of the first stackable container 10A run out, it can be easily removed from the stack.

Referring back to FIG. 1, the lid 28 is typically only used during shipment of the stackable container 10 from a producer to a store. The lid 28 may simply be a cover sheet, as shown in FIG. 1, or may be a partial or full depth cover (not shown). The lid 28 has a top panel 30 for covering a container opening defined by the uppermost edges of the first and second side panels 14 and 18, an uppermost edge of the back panel 24, and an uppermost edge of the front panel 26. The lid 28 also includes a front portion 32 for covering the display opening 29 in the front panel 26.

Figure 5:
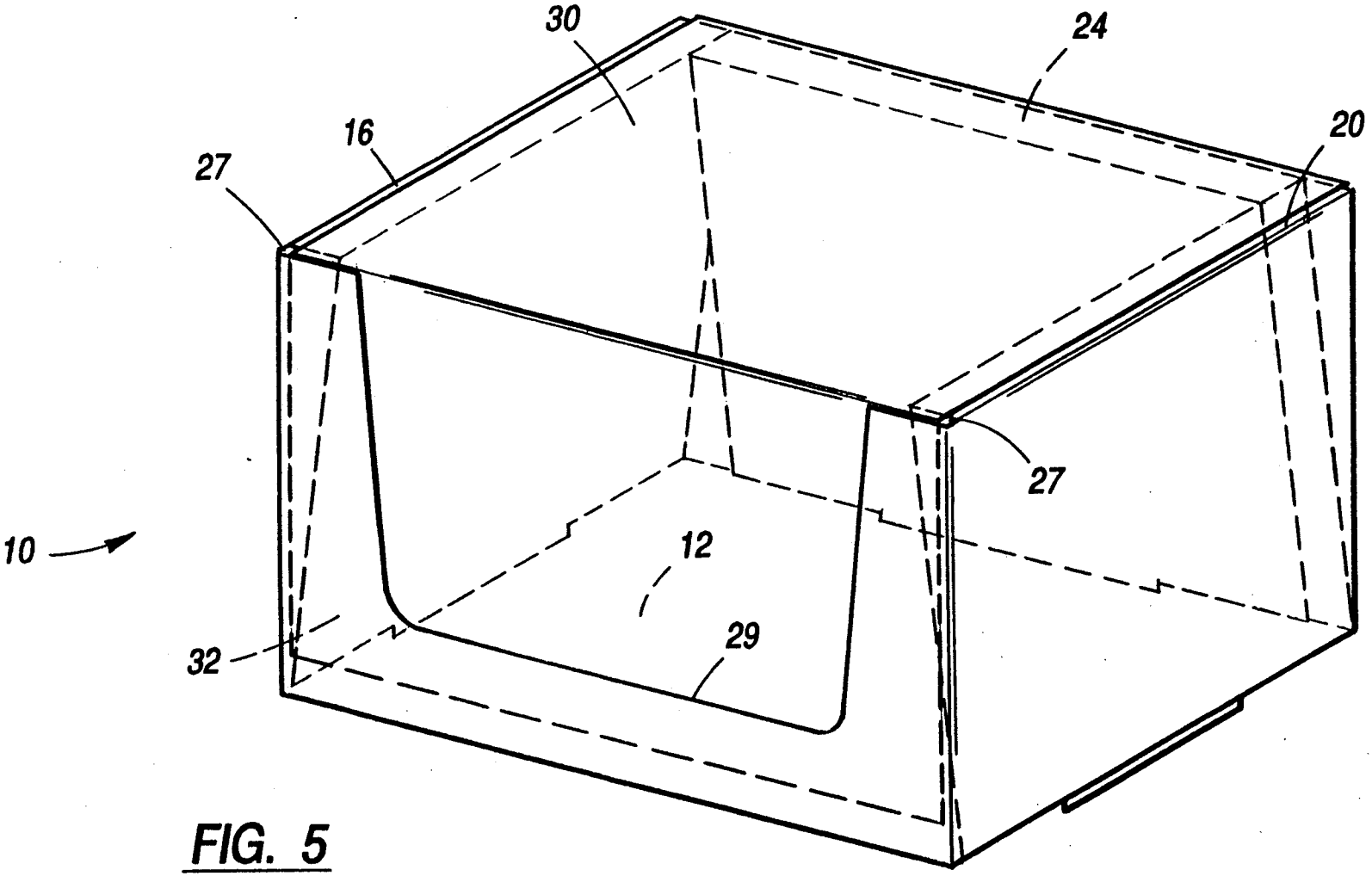
FIG. 5 is a perspective view of the preferred embodiment of the stackable container of the present invention, with the lid engaged to the container body.

FIG. 5 illustrates the stackable container 10 with the lid 28 engaged to the container body. The top panel 30 extends substantially across the ledges 16, 20, and 24. The top panel 30 is typically secured to the container body by an adhering means such as tape. Referring to both FIGS. 1 and 5, the front portion 32 of the lid 28, depicted by bold dotted lines in FIG. 5, is inserted into small gaps 27 formed between the side panels 14 and 18 and the front panel 26. As a result, the front portion 32 of the lid 28 covers the display opening 29 from within the container body. The small gaps 27 extend from the first and second rigid ledges 16 and 20 to the bottom portion 12. The gaps 27 are adapted to receive the front portion 32 of the lid 28 so that the front portion 32 abuts against the inside face of the front panel 26.

To inform a store owner as to contents of a stackable container 10 shipped to the store owner, the top panel 30 or the front portion 32 may be labeled. Once the stackable container 10 reaches the store owner, the lid 28 is removed and the container 10 may be stacked in the store along with other similar containers.

Figure 6:
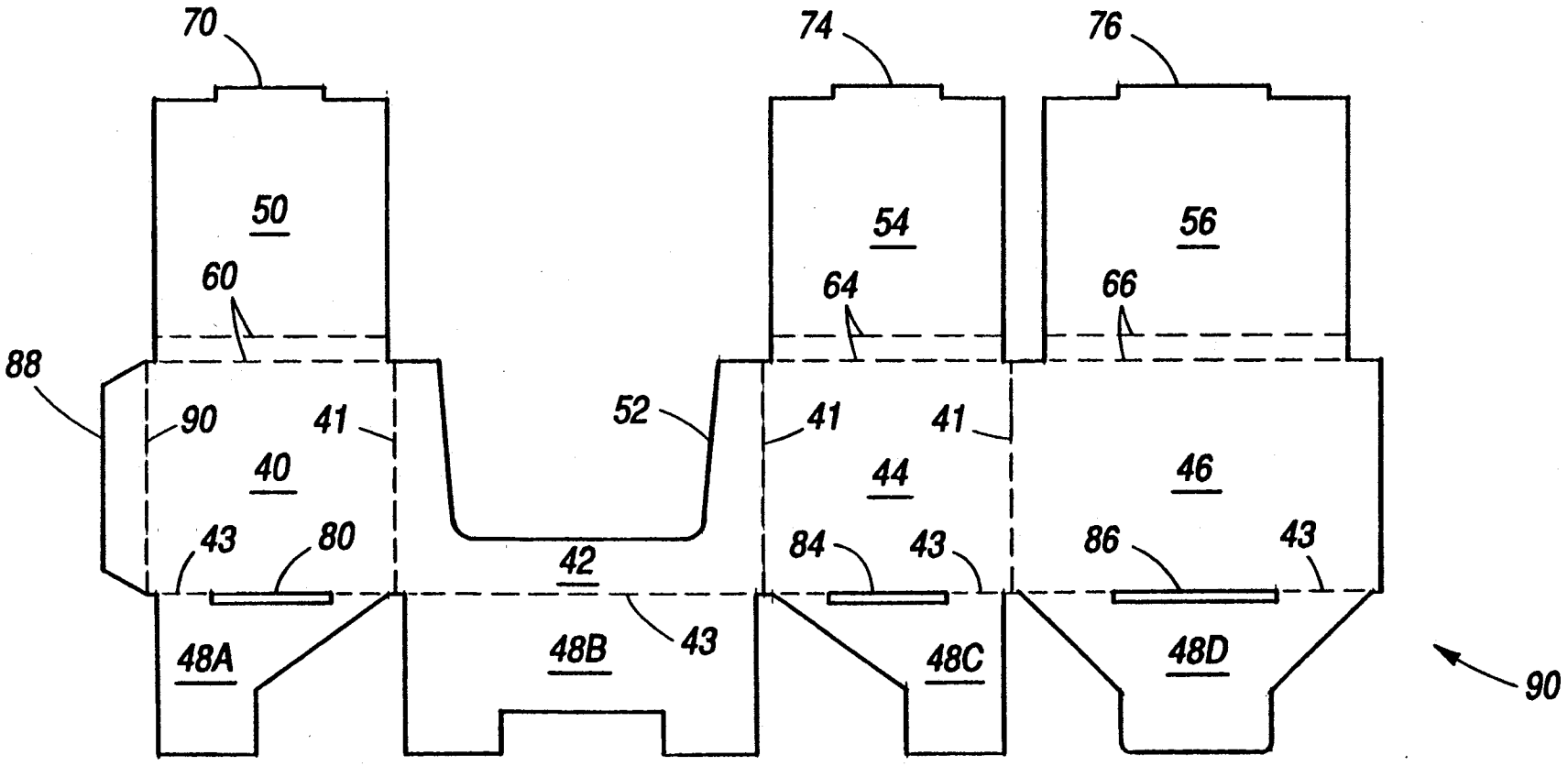
FIG. 6 is a top plan view of a corrugated or fiberboard blank used to form the stackable container shown in FIG. 1, according to an illustrative embodiment of the present invention.

Referring next to FIG. 6, there is shown a plan view of a corrugated or fiberboard blank used for forming a stackable container of the type described above in connection with FIG. 1. The blank 90 is in the form of a single, planar, unitary section of corrugated board or fiberboard. The blank 90 includes four horizontally aligned panels 40, 42, 44, and 46 which are linked by means of vertical score lines 41. The score lines 41 facilitate folding of the panels relative to each other. With respect to the manner in which these panels interact to define the stackable container shown in FIG. 1, the first panel 40 functions as an outer layer or the double-layered first side panel 14, the second panel 42 functions as the front panel 26, the third panel 44 functions as an outer layer of the double-layered second side panel 18, and the fourth panel 46 functions as an outer layer of the double-layered back panel 22.

Each of the four main panels comprising the blank 90 is provided with a bottom flap connected along a respective transverse edge by means of a corresponding score line. In particular, the first panel 40 includes a first bottom flap 48A, the second panel 42 includes a second bottom flap 48B, the third panel 44 includes a third bottom flap 48C, and the fourth panel 46 includes a fourth bottom flap 48D. The bottom flaps are connected to the panels by means of score lines 43. When the blank 90 is folded to form a stackable container, the bottom flaps 48A, 48B, 48C, and 48D cooperate with each other to form the bottom portion 12 of the stackable container shown in FIG. 1.

Three of the four main panels comprising the blank 90 are also provided with top flaps connected along respective transverse edges by means of corresponding pairs of parallel score lines. The first panel 40 includes a first top flap 50 connected by means of a first pair of parallel score lines 60. In connection with FIG. 1, the first top flap 50 functions as an inner layer of the double-layered first side panel 4. The first top flap 50 folds down over the first panel 40 along the first pair of score lines 60 to form the double-layered first side panel 14. The first top flap 50 is secured in a position substantially overlapping the first panel 40 by means of a first locking tab 70 engaged with a first locking slot 80. In connection with FIG. 1, the first locking tab 70 corresponds to the first locking tab 15 in FIG. 1. The area between the parallel score lines 60 functions as the first rigid ledge 16 of the first side panel 14.

The third panel 44 includes a second top flap 54 connected by means of a second pair of parallel score lines 64. In connection with FIG. 1, the second top flap 54 functions as an inner layer of the double-layered second side panel 18. The second top flap 54 folds down over the third panel 44 along the second pair of parallel score lines 64 to form the double-layered second side panel 18. The second top flap 54 is secured in position substantially overlapping the third panel 44 by means of a second locking tab 74 engaged with a second locking slot 84. In connection with FIG. 1, the second locking tab 74 corresponds to the second locking tab 19 in FIG. 1. The area between the parallel score lines 64 functions as the second rigid ledge 20 of the second side panel 18.

The fourth panel 46 includes a third top flap 56 connected by means of a third pair of parallel score lines 66. In connection with FIG. 1, the third top flap 56 functions as an inner layer of the double-layered back panel 22. The third top flap 56 folds down over the fourth panel 46 along the third pair of parallel score lines 66 to form the double-layered back panel 22. The third top flap 56 is secured in position substantially overlapping the fourth panel 46 by means of a third locking tab 76 engaged with a third locking slot 86. In connection with FIG. 1, the third locking tab 76 corresponds to the third locking tab 23 in FIG. 1. The area between the parallel score lines 66 functions as the third rigid ledge 24 of the back panel 22.

The second panel 42 has a slot 52 formed along its transverse edge. In connection with FIG. 1, the slot 52 functions as the display opening 29 in the front panel 26.

The sequence for transforming the blank 90 into the stackable container shown in FIG. 1 preferably is performed in the following steps. First, the panels 40, 42, 44, and 46 are folded along the score lines 41 to form the upright faces of the stackable container. The container is held in that form by a glue flap 88 connected to the first panel 40 by means of a score line 90. The glue flap 88 is secured, on the inside of the container, to the right edge of the fourth panel 46 by an adhering means such as glue. Second, the bottom portion of the stackable container is formed by folding the bottom flaps 48A, 48B, 48C, and 48D along the score lines 43. The closing sequence is to first fold the third bottom flap 48C, then fold the second and fourth bottom flaps 48B and 48D, and finally fold the first bottom flap 48A. Finally, the top flaps 50, 54, and 56 are folded down over their respective panels and locked into the locking slots via the locking tabs.

It is believed that the stackable container and the corrugated or fiberboard blank used for forming the stackable container and their attendant advantages will be understood from the foregoing description. It will be apparent that various changes may be made in the form, construction and arrangement of the parts thereof without departing form the spirit and scope of the invention or sacrificing all of its material advantages, the form hereinbefore described being merely a preferred or exemplary embodiment thereof.

We claim:

1. A stackable container formed from a unitary continuous corrugated or solid fiberboard blank for display and storage of shipped goods, comprising:

(a) a bottom portion;

(b) a first side panel connected to the bottom portion, the first side panel having a ridge ledge along an uppermost edge of the first side panel;

(c) a second side panel connected to the bottom portion and opposing the first side panel, the second side panel having a second ridge ledge along an uppermost edge of the second side panel;

(d) a back panel connected to the bottom portion and bridging the first and second side panels, the back panel having an associated pair of planar layers with a third rigid ledge connected to and bridging a top edge of each of the pair of planar layers; and (e) a front panel connected to the bottom portion and opposing the back panel and bridging the first and second side panels, the front panel having a display opening for viewing and accessing goods in the container, the display opening formed with first and second side edges, the first and second side edges being substantially adjacent the respective first and second ledges;

wherein the first, second, and third rigid ledges form a top opening having an area less than an area of the bottom portion so that the first, second and third rigid ledges are constructed and arranged to support another stackable container.

2. The stackable container as recited in claim 1, wherein the first side panel and the second side panel each include an associated pair of planar layers with a respective one of the first and second rigid ledges connected to and bridging between a top edge of an outer layer of the associated pair of planar layer and a top edge of an inner layer of the associated pair of planar layers.

3. The stackable container as recited in claim 2, wherein each of the pairs of planar layers associated with the first, second, and third rigid ledges extends from the respective rigid ledges to the bottom portion.

4. The stackable container as recited in claim 3 wherein the respective rigid ledge is integrally connected to the inner layer and the outer layer of the associated pair of planar layers, the outer layer of the associated pair of planar layers is integrally connected to the bottom portion, and the inner layer of the associated pair of planar layers is connected to the bottom portion by use of a locking tab on the inner layer which interlocks with a corresponding locking slot in the bottom portion.

5. The stackable container as recited in claim 4, further including a lid, wherein the lid covers the display opening in the front panel.

6. The stackable container as recited in claim 5, wherein the lid includes a top panel for covering a top opening defined by the uppermost edges of the first and second side panels, the uppermost edge of the back panel and an uppermost edge of the front panel, and a front portion for covering the display opening in the front panel.

7. The stackable container as recited in claim 1, wherein the bottom portion includes four bottom flaps connected along respective lower transverse edges of the first side panel, the second side panel, the back panel, and the front panel, the four bottom flaps being engaged with one another to form the bottom portion.

8. A corrugated or solid fiberboard blank used for forming a stackable container for display and storage of shipped goods, comprising:

four panels hingedly connected to each other along parallel score lines, (i) the first panel having a first top flap connected along an upper transverse edge of the first panel using a first pair of parallel score lines, (ii) the second panel having an upper transverse edge with a trough-shaped contour, the contour being constructed and arranged to allow a consumer to reach into an opening formed by the contour to retrieve an item stored in a container formed by the blank when another substantially similar container is stacked thereon, and (ii) the third panel having a second top flap connected along an upper transverse edge of the third panel using a second pair of parallel score lines.

9. The blank as recited in claim 8 wherein the fourth panel has a third top flap connected along an upper transverse edge of the fourth panel using a third pair of parallel score lines.

10. The blank as recited in claim 9, wherein the first, second, third, and fourth panels include respective first, second, third, and fourth bottom flaps connected along respective lower transverse edges, the respective first, second, third, and fourth bottom flaps being engageable with one another to form a bottom portion of the stackable container.

11. The blank as recited in claim 10, wherein the first top flap includes a first locking tap adapted for being interlocked with a first locking slot in the first bottom flap, the second top flap includes a second locking tab adapted for being interlocked with a second locking slot in the second bottom flap, and the fourth top flap includes a third locking tab adapted for being interlocked with a third locking slot in the fourth bottom flap.

* * * * *